US006991179B2

(12) United States Patent
Scheibe et al.

(10) Patent No.: US 6,991,179 B2
(45) Date of Patent: Jan. 31, 2006

(54) INJECTOR FOR INTERNAL COMBUSTION ENGINES

(75) Inventors: Wolfgang Scheibe, Ludwigsburg-Poppenweiler (DE); Horst Ressel, Winnenden (DE); Wilhelm Malitsky, Ilsfeld-Helfenberg (DE)

(73) Assignee: L'Orange GmbH, Stuttgart (DE)

( * ) Notice: Subject to any disclaimer, the term of this patent is extended or adjusted under 35 U.S.C. 154(b) by 320 days.

(21) Appl. No.: 10/470,202

(22) PCT Filed: Dec. 17, 2002

(86) PCT No.: PCT/EP02/14350

§ 371 (c)(1),
(2), (4) Date: Jul. 25, 2003

(87) PCT Pub. No.: WO03/054376

PCT Pub. Date: Jul. 3, 2003

(65) Prior Publication Data

US 2004/0061004 A1 Apr. 1, 2004

(30) Foreign Application Priority Data

Dec. 21, 2001 (DE) ..... 101 63 693

(51) Int. Cl.
*F02M 41/16* (2006.01)

(52) U.S. Cl. ..... 239/96; 88/124; 88/584; 88/585.1; 88/533.9; 123/472

(58) Field of Classification Search ..... 239/88–92, 239/96, 124, 584, 585.1, 533.2, 533.3, 533.9; 123/446, 447, 294, 472
See application file for complete search history.

(56) References Cited

U.S. PATENT DOCUMENTS

| | | | | |
|---|---|---|---|---|
| 5,694,903 | A * | 12/1997 | Ganser | 239/96 |
| 5,806,766 | A * | 9/1998 | Krueger et al. | 239/96 |
| 5,915,361 | A | 6/1999 | Heinz et al. | |
| 5,975,428 | A | 11/1999 | Potschin et al. | |
| 6,092,737 | A | 7/2000 | Bosch et al. | |
| 6,142,443 | A * | 11/2000 | Potschin et al. | 123/472 |
| 6,616,062 | B2 * | 9/2003 | Boecking | 239/124 |

FOREIGN PATENT DOCUMENTS

| | | |
|---|---|---|
| DE | 19826719 A1 | 12/1999 |
| EP | 0907018 A2 | 4/1999 |
| EP | 0971123 A2 | 1/2000 |
| JP | 2000-18120 | 1/2000 |

* cited by examiner

*Primary Examiner*—Steven J. Ganey
(74) *Attorney, Agent, or Firm*—Crowell & Moring LLP

(57) ABSTRACT

A fuel injector for internal combustion engines having a control valve arranged upstream of a main flow valve is configured so that the connection leading over the control chamber between the inlet and outlet, which is regulated by the valve member of the control valve, directs the function of a throttle position, among other things, by way of a limit stop of the control piston against the front wall overlapping the control chamber for the purpose of reducing control leakage.

31 Claims, 2 Drawing Sheets

INJECTOR FOR INTERNAL COMBUSTION ENGINES

BCKGROUND AND SUMMARY OF THE INVENTION

The invention concerns a fuel injector for internal combustion engines, in particular for internal combustion engines operated with diesel or heavy fuel as injection medium.

Considerable actuating or retention forces must be applied to some extent in fuel injectors to control the valve closing member of a main flow valve. A control valve is provided for this purpose upstream of the main flow valve, which has a control chamber that is limited to a certain extent in its volume by means of an upwardly movable control piston, whose positioning motions can be transmitted to the valve closing member of the main flow valve, for example, by means of a nozzle needle of an injection nozzle or an injection quantity control valve. The actuating forces of the control piston are dependent upon the pressure in the control chamber, in which a throttled high-pressure inlet ends, and from which a throttled and controlled outlet starts. If the outlet is open, then the pressure in the control chamber is reduced and part of the control chamber volume is displaced into the outlet by means of the control piston. Considerably greater than this quantity of injection medium also used as control medium, which is displaced into the outlet, is the leakage that occurs when the outlet is open due to the bypass between the high-pressure inlet and the low-pressure outlet, notwithstanding the two-sided throttling as control leakage.

This applies when the ends of the inlet and outlet are exposed toward the control chamber, regardless of which of the wall areas of the control chamber, which are not passed over or covered by the control piston, are allocated thereto.

A pertinent allocation can be found in European publication EP 0 907 018 A2, wherein the inlet-side opening cross section to the control chamber is allocated to its front wall and overlaps the front side of the control piston, and the outlet-side opening cross section lies radially outside of the front-side range of the control piston in the area that is not passed over by the control piston. In this way, the control member and the corresponding actuating devices of the control valve are arranged radially with respect to the control piston in accordance with the radial position of the outlet-side opening cross section, to achieve a shortened and compact design of the fuel injector.

In a fuel injector of the kind mentioned above, the inlet to the control chamber is radially outside of the front-side range of the control piston with respect to its opening cross section and is allocated to the outlet-side opening cross section of the front wall of the control chamber that overlaps the front side of the control piston, while the control piston has a vaulting with respect to its front side, which is part of the limit stop that overlaps the outlet-side opening cross section allocated to the front wall. In this way, by means of the limit stop with an open control valve and depressurized control chamber, a position of the control piston is produced, which more or less blocks the connection between the inlet and outlet. A solution of this kind is connected to the fact that, due to the flat-shaped vaulting of the front side of the control piston, an essential part of the front-side cross section surface is not available for a direct pressurization in connection with the changeover of the control piston from its open position into the blocked position, so that the adjustment of the actuated valve closing member, for example, the nozzle needle, is delayed in the closing direction in accordance with the delayed displacement of the control piston. A technical consideration of these facts is difficult by means of a corresponding actuation of the control valve, since already small geometrical changes in the limit stop or in the small gaps produced by this type of limit stop have a greater effect on the response characteristic of the control piston, so that a stable accurate control of the closure movement of the actuated valve closing member is made more difficult, if not impossible.

It is an object of the invention to configure a fuel injector of the kind mentioned above so that, starting from the control valve and its activation, the displacement of the control piston and therefore the closing motion of the valve closing member can be accurately initiated also in a stable manner with respect to the appropriate operating times.

This is attained in accordance with the invention in a fuel injector of the kind mentioned above in which the position of the limit stop in a front-side peripheral zone of the control piston and the end of the inlet in a gap delimited by the limit stop is given by a provided admission surface for the injection medium introduced at the inlet side. The injection medium is under high pressure and is used as control medium, and this has as a consequence that, when the control valve is activated and the control piston is displaced against the front wall of the space that is delimited by the limit stop, and when the control piston comes ever closer to the front wall, a pressure cushion is formed, whose volume is filled by means of a connection to the inlet side, and therefore to the pressurized side, with a simultaneously increasing throttling over the limit stop. As a consequence, the limit stop almost forms a pinch gap, via which namely an essential reduction of the leakage quantity that flows in the bypass from the inlet to the outlet is achieved, but which, in particular considering the short control times, allows a specific average quantity as leakage gap. In this way the starting position is created wherein, when the control valve is closed in consideration of the end of the inlet into the gap delimited by the limit stop, an abrupt pressurization of the front face of the control valve is achieved, which makes possible an accurate control of the closing motion of the valve closing member. The described pinch gap linkage ensures, at the same time, that the limit stop, as a rule, is not stressed or is stressed very little when fulfilling the function of the path-limiting seal boundary with sensitive but highly stressed bearing surfaces (in similitude to the bearing surface of the nozzle needle of a fuel injector), so that long-term stable working conditions that remain the same are also ensured from a geometrical point of view. Basically, a necessary connection, even though short on average or only temporary, that is, a very short-term sealing, is allowed within the scope of the invention, since otherwise a complete sealing over the seal boundary with open control valve would be given, but such a complete sealing would prevent a reaction of the piston to the input of the control valve.

In one configuration of the invention, the gap space can be formed by a front-side depression of the control piston and/or a depression in the side of the front wall, wherein the boundary of the gap can be configured as running contrary to the limit stop or can also be configured by steps, whereby, aside from the production-related possibilities, also the flow conditions can be influenced with respect to the pinch gap formation.

It was also shown to be practical to provide an annular-shaped free space between the control piston and the receiving bore in the limit stop of the neighboring axial area and allocating the outlet with its opening cross section o this free space, wherein the free space is formed in the axial end area allocated to the front wall preferably by means of a widening of the bore for receiving the control piston, but can also be formed by a specific diameter reduction of the control piston adjacent to its front face. This free space in the form of an annular space can be utilized in accordance with the invention to form the pinch gap, in that its front-side boundary is axially offset with respect to the front wall and forms a small step, so that the piston axially overlaps the step in its upper limit position adjacent to the front wall in the area of the seal boundary, whereby a particularly intensive damping of the control piston results when traveling into this upper limit and/or stop position of the control piston.

Further details and features of the invention result from the claims, and the invention is explained in the following with reference to the drawings.

BRIEF DESCRIPTION OF THE DRAWINGS

FIGS. 2 and 3 show highly schematized and enlarged cutout illustrations of a control valve with the configuration according to the invention, wherein FIG. 2 shows the control valve in its open position and FIG. 3 shows the control valve in its closed position.

DETAILED DESCRIPTION OF THE INVENTION

Figure 1:
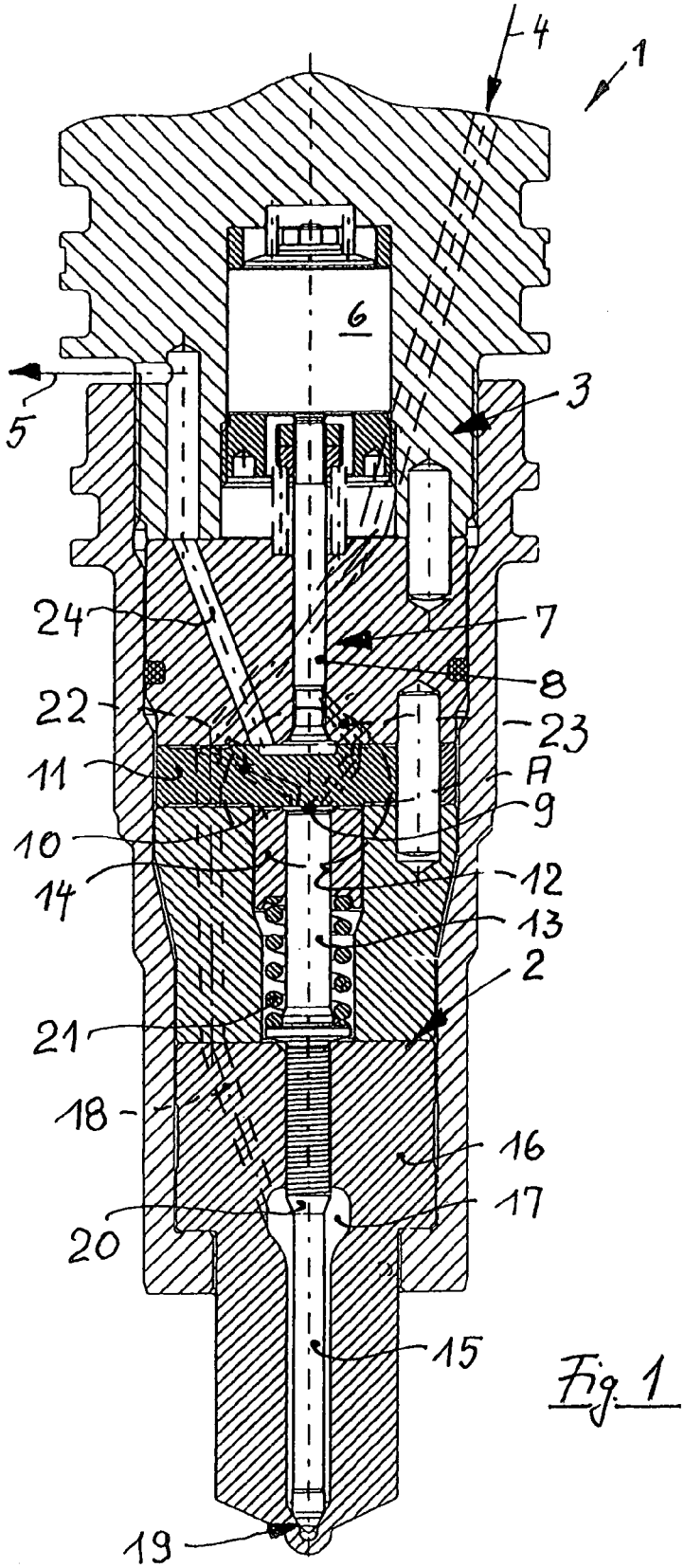
FIG. 1 shows a schematic overall view of a fuel injector in section for the purpose of clarifying its overall design and the function of the control valve.

The fuel injector 1 shown in the schematized overall view according to FIG. 1 consists essentially of a nozzle part 2 and a control and actuator part 3, which also forms functionally the nozzle holder and to which the supply connection symbolically illustrated by the arrow 4 for the injection medium under high pressure is allocated, in particular diesel or heavy fuel. On the feedback side, the corresponding feedback-side connection is symbolized by the arrow 5.

The control and actuator part 3 comprises a magnetic disk 6, by means of which the control valve 7 is actuated, which comprises the valve member 8 acted on by the magnetic disk 6, by means of which the pressurization of a control chamber 9 is controlled.

The control chamber 9 is overlapped in the illustration according to FIG. 1, in a modular design of the injector, on the one hand, by the front wall 10 of an intermediate plate 11 and, on the other hand, by a bore 12, and is delimited by a control piston 13 guided therein, which acts on the nozzle needle 15. The bore 12 is provided in the illustration according to FIG. 1 in a sleeve 14, which in turn is connected coaxially to a nozzle needle 15 on the control piston 13. The nozzle needle 15 forms the valve member of a main flow valve, whose seat is allocated to the nozzle element 16, which at the same time also forms the guide for the nozzle needle 15, and has a pressure chamber 17, on which the supply of injection medium on the high-pressure side takes place by means of the line connection 18 shown with the dashed line. The nozzle needle 15 rests in a sealing manner in the closed position, which is shown, in the nozzle seat 19 and is charged by means of the pressure existing in the pressure chamber 17 by actuating its pressure shoulder 20 in the opening direction. In the opposite direction, the nozzle needle 15 is acted on by means of the spring 21, as well as also by the pressure existing in the control chamber 9, if, as shown in FIG. 1 with a dashed line, the control chamber 9 is supplied from the side of the high pressure line connection 18, which is also shown with a dashed line, by the throttled inlet 22 shown with a dashed line, and a throttled outlet 23 by means of which the valve member 8 is blocked in its connection to the feedback (arrow 5) indicated by the line 24. If the valve member 8 is transferred by flooding the magnetic actuator 6 into an open position (not shown in FIG. 1), then the outlet 23 is connected to the line 24, and the control chamber 9 is depressurized, so that the nozzle needle 15 lifts off the nozzle seat 19 actuated by the pressure shoulder 20 in the opening direction and the injection is released.

In accordance with the described arrangement with throttled high-pressure inlet 22 and throttled and controlled outlet 23 toward the low-pressure side, when the connection of the outlet 23 to the feedback is released according to arrow 5 in connection with the depressurization in the control chamber 9, the control chamber volume is reduced by means of the upward motion of the control piston 13 connected with the opening of the nozzle needle 15 and with the same direction, and a corresponding volume is pushed toward the feedback 5. Otherwise, the bypass connection created by the opening of the valve member 8 remains open until the valve member 8 is reversed, regardless of the throttling in the inlet 22 and in the outlet 23. The open throughflow connection causes considerable leakage losses.

Figure 2:
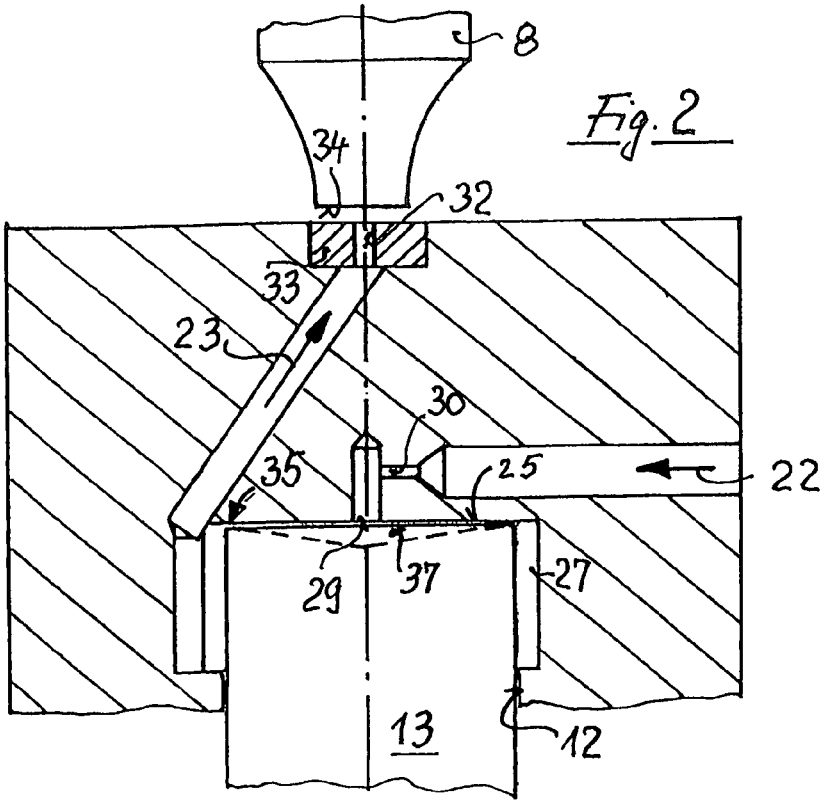
Figure 3:
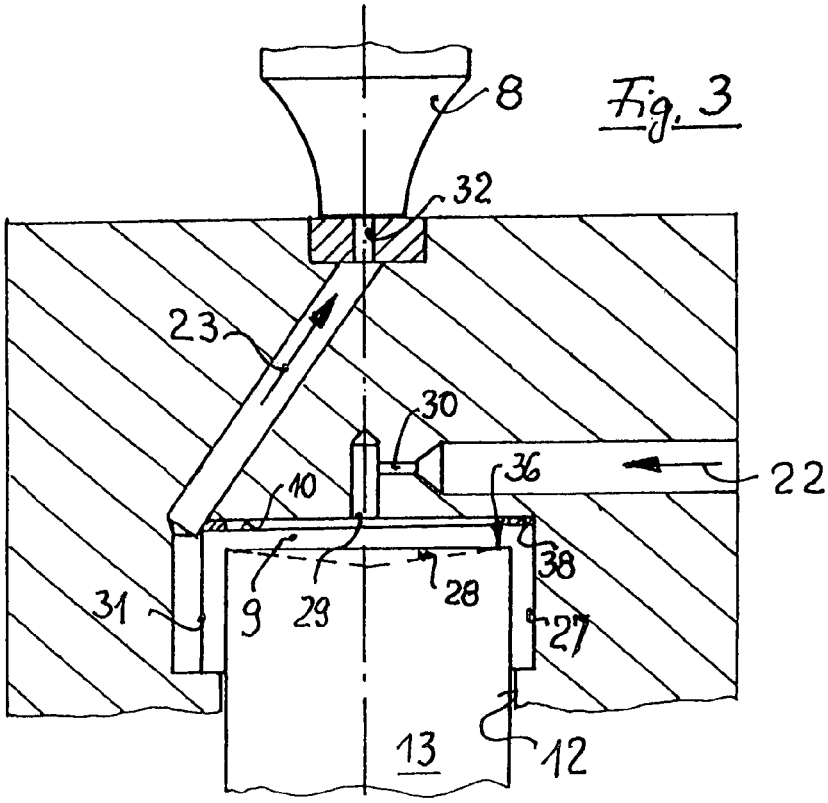

FIGS. 2 and 3 show in a highly simplified schematic illustration sections of a configuration according to the invention of the area A, wherein regardless of the deviations from the design of the corresponding parts, the same reference numerals as in FIG. 1 are used, and wherein the correspondingly described functions and designs are not bound to the design of the fuel injector 1 according to FIG. 1, for example, the modular design of the injector 1 or the like.

The valve member of the control valve is therefore identified with the numeral 8, and the control piston is identified with the numeral 13. The control piston 13 is guided in the bore 12 with an upward motion and delimits with the bore 12 and the front wall 10 covering the bore 12 the control chamber 9, while the control chamber 9 adjacent to the front wall 10 is enlarged in diameter by a radial widening 27 of the bore 12, so that an annular free space, in particular a cylindrical annular chamber, is provided around the front-side end of the control piston 13 opposite to the front wall 10. In the area that radially overlaps the front side 28 of the piston 13, the opening cross section 29 of the inlet 22 lies on the control chamber 9. In the inlet 22 lies a throttle 30. The outlet 23 has an opening cross section 31 on the side of the control chamber. A throttle 32 is allocated to the outlet 23, which in the design example is formed by a bore in a seat disk 33, which covers the valve member 8 in the closed position provided in the design example with a flat blocking surface 34 and is locked.

Between the control piston 13 and the front wall 10 a limit stop 35 is formed when the control chamber 9 is depressurized, and the control piston 13 is displaced upward against the front wall 10, which is allocated to the edge zone 36 of the control piston 13 in the transition between the front wall 10 and the front side 28, while the same is formed, for example, by reverting the piston 13 on the front side within the edge zone 36, as shown in FIGS. 2 and 3. In a similar way, a corresponding configuration could also be allocated to the front wall 10. The axially reverted configuration of the front-wall of the control piston 13 opposite to the edge zone 36 leads in the upper limit position of the control piston 13 corresponding to the opening position of the valve member 8 shown in FIG. 2 to the formation of a flat gap 37 enclosed at its periphery by a limit stop 35 formed by the periphery of the piston 13, which is also blade-shaped, if required, whose depth is shown drawn over in the figures, and which is stepped radially outwardly or runs into the peripheral zone 36.

This design has, in connection with the end (opening cross section 29) of the inlet 22, the consequence on the annular space enclosed by the limit stop 35 that, when the outlet 23 is opened by means of the valve member 8 against the feedback (arrow 5), and the control piston 13 is consequently displaced upward against the front wall 10 as a consequence of pressurization in the nozzle needle 15 in the opening direction, the control piston 13 runs against a pressure cushion fed through the still open inlet 22, so that even with the desired almost abrupt opening motions of the nozzle needle 15, the same is intercepted in a damped manner in the end phase because the limit stop 35 has the function of a pinch gap. According to this function, the limit stop 35 forms as a rule also no absolute seal boundary, but rather a throttle gap, which first reduces considerably the leakage when the valve member is open. Furthermore, it is also ensured in this way that, when the valve member 8 is closed, the gap volume is increased almost abruptly to the pressure level of the inlet 22, while the configuration according to the invention also creates the prerequisites that the front face 25 of the control piston 13 is acted on completely without noticeable time delay. In addition, the solution in accordance with the invention prevents that, in the opening phase of the valve member 8, the injection medium under high pressure flowing between the front wall 10 and the front face (corresponding to the hydrodynamic paradox) would lead to an adhesion of the control piston 13 with its front face 25 on the front wall 10, which would have as a consequence a delay of the desired almost abrupt closure of the nozzle needle 15 by a corresponding displacement of the control piston 13 when the valve member 8 is reversed from the opening into the closing position.

In this way, the invention creates a solution with simple means, which also reduces the leakage as well as also increases the operational safety by a reduction of the abrasion.

The desired "pinch gap formation" and damping function can also be achieved or improved within the scope of the invention in that the annular free space formed by the radial widening 27 is not pulled through up to the front wall 10, so that an annular step 38 is produced, into which the control piston 13 plunges when its end position is reached. In this way, despite the only small axial overlap, a radial narrow throughflow gap and a corresponding damping result. The annular step 38, shown as an example in FIG. 3, is illustrated schematically for the purposes of clarity in a way that deviates from FIGS. 1 and 2, and the element that receives the cylinder bore 12 is shown shaded, but is for practical purposes configured as one piece with this element, for example, with reference to an overall view according to FIG. 1, as one piece with the intermediate plate 11.

What is claimed is:

1. A fuel injector for internal combustion engines, operated with diesel or heavy fuel as injection medium, comprising:

a control valve arranged upstream of a main flow valve, and a control chamber having a changeable volume and a limit stop for a displaceable control piston guided in a bore in a direction of a front wall of the control chamber, said control chamber lying between a throttled inlet and a throttled outlet with cross sections opening to the control chamber, wherein one of said throttled inlet and said throttled outlet lies on a front wall side overlapping a front side of the control piston, and the other one of said throttled inlet and said throttled outlet lies radially outside of a front-side contour of the control piston, and wherein the limit stop for the control piston acts between a peripheral zone of the front side of the control piston and the front wall of the control chamber, forms a throttled position between the inlet and the outlet and encloses a gap that remains between the front wall and the control piston at which the inlet ends.

2. The fuel injector according to claim 1, wherein the gap is formed by a front-side recess of the control piston.

3. The fuel injector according to claim 1, wherein the gap is formed by a recess in the side of the front wall.

4. The fuel injector according to claim 2, wherein the recess runs into a stop edge allocated to the limit stop.

5. The fuel injector according to claim 2, wherein the recess is offset in a stepped manner against a stop edge allocated to the limit stop.

6. The fuel injector according to claim 1, wherein an annular-shaped free space is provided between the control piston and the receiving bore in an axial area adjacent to the limit stop.

7. The fuel injector according to claim 6, wherein the free space is formed by an axial area of the control piston that is reduced in diameter.

8. The fuel injector according to claim 6, wherein the free space is formed by an axial area of the bore with an enlarged diameter that receives the control piston.

9. The fuel injector according to claim 6, wherein the outlet is provided starting from the free space.

10. The fuel injector according to claim 6, wherein the annular-shaped free space ends at a distance to the front wall in such a way that the control piston runs in its upper end position into an axial overlapping position with respect to an annular step formed thereby.

11. The fuel injector according to claim 2, wherein the gap is also formed by a recess in the side of the front wall.

12. The fuel injector according to claim 2, wherein an annular-shaped free space is provided between the control piston and the receiving bore in an axial area adjacent to the limit stop.

13. The fuel injector according to claim 3, wherein an annular-shaped free space is provided between the control piston and the receiving bore in an axial area adjacent to the limit stop.

14. The fuel injector according to claim 4, wherein an annular-shaped free space is provided between the control piston and the receiving bore in an axial area adjacent to the limit stop.

15. The fuel injector according to claim 5, wherein an annular-shaped free space is provided between the control piston and the receiving bore in an axial area adjacent to the limit stop.

16. The fuel injector according to claim 12, wherein the free space is formed by an axial area of the control piston that is reduced in diameter.

17. The fuel injector according to claim 12, wherein the free space is formed by an axial area of the bore with an enlarged diameter that receives the control piston.

18. The fuel injector according to claim 12, wherein the outlet is provided starting from the free space.

19. The fuel injector according to claim 12, wherein the annular-shaped free space ends at a distance to the front wall in such a way that the control piston in its upper end position into an axial overlapping position with respect to an annular step formed thereby.

20. The fuel injector according to claim 13, wherein the free space is formed by an axial area of the control piston that is reduced in diameter.

21. The fuel injector according to claim 13, wherein the free space is formed by an axial area of the bore with an enlarged diameter that receives the control piston.

22. The fuel injector according to claim 13, wherein the outlet is provided starting from the free space.

23. The fuel injector according to claim 13, wherein the annular-shaped free space ends at a distance to the front wall in such a way that the control piston in its upper end position into an axial overlapping position with respect to an annular step formed thereby.

24. The fuel injector according to claim 14, wherein the free space is formed by an axial area of the control piston that is reduced in diameter.

25. The fuel injector according to claim 14, wherein the free space is formed by an axial area of the bore with an enlarged diameter that receives the control piston.

26. The fuel injector according to claim 14, wherein the outlet is provided starting from the free space.

27. The fuel injector according to claim 14, wherein the annular-shaped free space ends at a distance to the front wall in such a way that the control piston in its upper end position into an axial overlapping position with respect to an annular step formed thereby.

28. The fuel injector according to claim 15, wherein the free space is formed by an axial area of the control piston that is reduced in diameter.

29. The fuel injector according to claim 15, wherein the free space is formed by an axial area of the bore with an enlarged diameter that receives the control piston.

30. The fuel injector according to claim 15, wherein the outlet is provided starting from the free space.

31. The fuel injector according to claim 15, wherein the annular-shaped free space ends at a distance to the front wall in such a way that the control piston in its upper end position into an axial overlapping position with respect to an annular step formed thereby.

* * * * *